US009359052B2

(12) United States Patent
Ketterman et al.

(10) Patent No.: US 9,359,052 B2
(45) Date of Patent: Jun. 7, 2016

(54) REVERSING PROPULSION DEVICE FOR WATERCRAFT

(71) Applicant: Hobie Cat Company, Oceanside, CA (US)

(72) Inventors: Gregory Scott Ketterman, Oceanside, CA (US); James Taylor Czarnowski, Fallbrook, CA (US); Jason Christopher Kardas, Vista, CA (US); Philip James Dow, Oceanside, CA (US)

(73) Assignee: Hobie Cat Company, Oceanside, CA (US)

( * ) Notice: Subject to any disclaimer, the term of this patent is extended or adjusted under 35 U.S.C. 154(b) by 293 days.

(21) Appl. No.: 14/055,270

(22) Filed: Oct. 16, 2013

(65) Prior Publication Data

US 2014/0134901 A1 May 15, 2014

Related U.S. Application Data

(60) Provisional application No. 61/725,642, filed on Nov. 13, 2012.

(51) Int. Cl.

| | |
|---|---|
| ***B63H 1/36*** | (2006.01) |
| ***B63H 16/18*** | (2006.01) |
| ***B63H 16/20*** | (2006.01) |

(Continued)

(52) U.S. Cl.

CPC .. *B63H 1/36* (2013.01); *B63H 1/32* (2013.01); *B63H 16/12* (2013.01); *B63H 16/18* (2013.01); *B63H 16/20* (2013.01); *B63H 2016/202* (2013.01)

(58) Field of Classification Search

CPC ..... B63H 1/30; B63H 1/32; B63H 1/36; B63H 16/08; B63H 2016/085; B63H 16/16; B63H 16/18; B63H 2016/202; B63H 16/12; B63H 16/20

USPC ..... 440/13–22, 25

See application file for complete search history.

(56) References Cited

U.S. PATENT DOCUMENTS

| | | | | |
|---|---|---|---|---|
| 2,003,934 A * | 6/1935 | Hansel | ..... | F16C 33/6618 156/333 |
| 2,286,914 A | 6/1942 | Knapp | | |
| 2,873,713 A | 2/1959 | Bastrup | | |

(Continued)

FOREIGN PATENT DOCUMENTS

| | | |
|---|---|---|
| GB | 452719 | 8/1936 |
| JP | 52-033290 | 3/1977 |

(Continued)

*Primary Examiner* — Ajay Vasudeva

(74) *Attorney, Agent, or Firm* — Joseph E. Mueth, Esq.

(57) ABSTRACT

A human propelled watercraft having a pair of flexible fins extending into the water each adapted to oscillate through an arcuate path in a generally transverse direction with respect to the central longitudinal dimension of said watercraft. Pedals are provided for applying input force whereby as input force is applied, the flexible fins can twist to form an angle of attack for providing forward thrust with respect to the longitudinal dimension of the watercraft while moving in both directions along the arcuate path. The user can pull a lever and cause the fins to rotate 180° and produce thrust in the reverse direction. The fins are able to pivot and swing aft to avoid damage if there is a collision with a submerged object. The fins are more efficient, durable, and adjustable. Simple plastic roller bearings have been adapted to reduce mechanical friction without the need for oil seals.

4 Claims, 9 Drawing Sheets

(51) Int. Cl.
*B63H 16/08* (2006.01)
*B63H 1/32* (2006.01)

(56) References Cited

U.S. PATENT DOCUMENTS 2,948,255 A 8/1960 Sbrana
3,695,211 A * 10/1972 Gross ..... B63H 16/12 440/15
3,986,473 A * 10/1976 Truzzi ..... B63H 25/42 114/39.22
4,427,392 A * 1/1984 Schneider ..... B63H 16/14 440/30
4,490,119 A 12/1984 Young
4,936,802 A 6/1990 Ueno
4,960,396 A * 10/1990 Stolzer ..... B63H 16/12 114/153
5,460,551 A 10/1995 Beres
6,022,249 A * 2/2000 Ketterman ..... B63H 1/36 400/21
7,637,791 B2 * 12/2009 Ketterman ..... B63H 1/36 440/13

FOREIGN PATENT DOCUMENTS

JP 01-144198 10/1989
JP 03-035897 4/1991

* cited by examiner

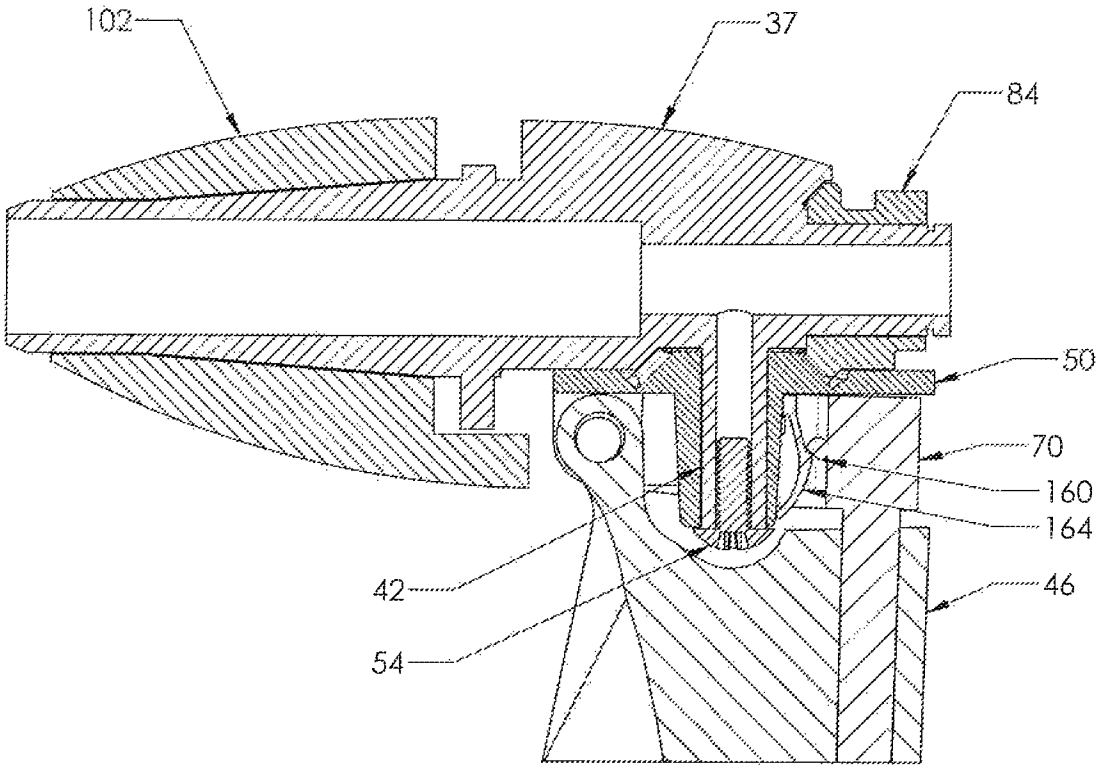
Figure 8
Section A-A
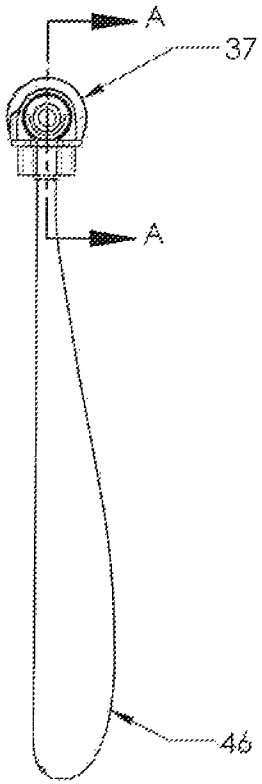

Detail A

Section B:B

Section C:C

REVERSING PROPULSION DEVICE FOR WATERCRAFT

Application claim the benefits of the U.S. Provisional Patent Application 61/725,642, filed Nov. 13, 2012.

FIELD OF INVENTION

This invention relates to novel propulsion means for a watercraft using oscillating foils with:

1) ability to reverse thrust, 2) fins that have the ability to retract to avoid damage, 3) fins that are more durable, more efficient and more adjustable 4) uses five sets of roller bearings to reduce mechanical friction.

BACKGROUND OF INVENTION

Oscillating fin propulsion has been used to produce efficient propulsion. This technology appears in U.S. Pat. No. 6,022,249, the text and drawings of which are expressly incorporated herein by reference, which discloses a novel watercraft, such as a kayak, which typically include a hull with a keel, having propulsion means extending below the water line. The propulsion means comprises a pair of fins each having a leading edge and a trailing edge and adapted to oscillate through an arcuate path in a generally transverse direction with respect to the central longitudinal dimension of the watercraft. Foot operated pedals worked from the cockpit are operatively associated with the propulsion means for applying input force to the propulsion means. The propulsion means includes a pair of fins which twist to form an angle of attack for providing forward thrust with respect to the longitudinal dimension of the watercraft while moving in both directions along the arcuate path.

SUMMARY OF THE INVENTION

There are four features that are new in this invention which are improvements to the invention disclosed in U.S. Pat. No. 6,022,249:

1) Reversing

2) Kick up fins

3) Better fins

4) Roller bearings

Reverse

This invention is one aspect comprises a watercraft having propulsion means extending below the water line comprising a pair of flexible fins each adapted to oscillate through an arcuate path in a generally transverse direction with respect to the central longitudinal dimension of said watercraft, means for positioning said propulsion means to propel said watercraft forward and to rotate said propulsion means 180° with respect to the longitudinal dimension of the watercraft to propel said watercraft aft, and means operatively associated with said propulsion means for applying input force to said propulsion means whereby as input force is applied, said flexible fins can twist to form an angle of attack for providing forward or aft thrust with respect to the longitudinal dimension of the watercraft while moving said flexible fins in both directions along said arcuate path.

A novel device adapted to be placed in a watercraft, said device including propulsion means extending below the water line comprising a pair of flexible fins each adapted to oscillate through an arcuate path in a generally transverse direction with respect to the central longitudinal dimension of said watercraft, means for positioning said propulsion means to propel said watercraft forward and to rotate said propulsion means 180° with respect to the longitudinal dimension of the watercraft to propel said watercraft aft, and means operatively associated with said propulsion means for applying input force to said propulsion means whereby as input force is applied, said flexible fins can twist to form an angle of attack for providing forward or aft thrust with respect to the longitudinal dimension of the watercraft while moving said flexible fins in both directions along said arcuate path.

The reversing feature is accomplished by rotating the fin assembly (fin, mast link, mast gears) 180° with respect to the sprocket. The fin assembly is pivotally mounted to the sprocket on a shaft which is perpendicular to the sprocket shaft. There are two spring loaded balls that engage detents on the mast gear and create a force to hold the fin in either the forward thrust position or the reverse thrust position.

The fin assemblies are forced to rotate when a pair of pins in the spine slide down and engage the sprocket gear and force the gear to stop turning relative to the spine. There are two pairs of pins in the spine—one pair is for forward and one is for reverse. The sprocket gears have two grooves—one for forward and one for reverse which are 180° opposed to each other. When the reverse pins are pushed down the end of the pin will slide on the outer surface of the sprocket gear until the pin drops into the reverse groove. When the stroke is reversed the pin will stop the motion of the sprocket gear but the sprocket and the mast gear will continue to rotate. Since the sprocket gear is meshing with the mast gear this relative motion will cause the mast and fin assembly to rotate 180° to the reverse position.

As long as the fin assembly is in the reverse position, the pin will just move in the groove without any contact with the sprocket gear. If the fin assembly is bumped out of the reverse position, the reverse pin will contact the end of the groove and rotate the fin assembly back into the reverse position.

There is a lever on the back of the spine which moves a shaft fore and aft. Cams on this shaft force lifters to move down. For example when the lever is moved forward lifters associated with the forward thrust pins push down on springs which push down on the forward pins. There are lighter springs that lift up on the pins to return them to the neutral position.

Kick Up Fins

In another aspect, the invention comprises a watercraft having propulsion means extending below the water line comprising a pair of flexible fins each adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path, each said fin being carried at its upper trailing edge by a fixed pivot and at its upper leading edge by a retainer which is normally engaged while being disengageable when said leading edge strikes a resistance element allowing said fin to pivot aft to clear the resistance element and re-engageable as the fin rotates forward and resumes producing thrust.

A novel device adapted to be placed in a watercraft, said device including propulsion means extending below the water line comprising a pair of flexible fins each adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path, each said fin being carried at its upper trailing edge by a fixed pivot and at its upper leading edge by a retainer which is normally engaged while being disengageable when said leading edge strikes a resistance element allowing said fin to pivot aft to clear the resistance element and re-engageable as the fin rotates forward and resumes producing thrust.

Under normal conditions the fins provide thrust which pushes the fins in the forward position. If the fin strikes a submerged object the fin and mast assembly will overcome the detent force and rotate aft and avoid any damage to the fin or mast. After the object is cleared and the fin produces thrust again the fin will rotate forward again. The mast link will depress the mast clip and snap into position. The mast clip will hold the fin assembly in the forward position.

More Durable, More Efficient, and More Adjustable Fins

In yet another aspect, the invention comprises a watercraft having propulsion means extending below the water line comprising a pair of flexible fins each adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path, wherein said fins have an essentially hard leading and trailing edges which join at the top to form a thinner tip of about 0.06 inches and the area between the edges being of a softer, flexible material which is flexible in bending.

A novel device adapted to be placed in a watercraft, said device including propulsion means extending below the water line comprising a pair of flexible fins each adapted to oscillate through an arcuate path in a generally transverse direction with respect to the central longitudinal dimension of said watercraft, and means operatively associated with said propulsion means for applying input force to said propulsion means whereby as input force is applied said flexible fins can twist to form an angle of attack for providing forward thrust with respect to the longitudinal dimension of the watercraft while moving in both directions along said arcuate path, wherein said fins have an essentially hard leading and trailing edges which join at the top to form a thinner tip of about 0.06 inches and the area between the edges being of a softer, flexible material which is flexible in bending.

The current fin design is limited to relatively soft and flexible material to allow the flex and twist to assume the shape of a propeller blade. This invention comprises a fin design that allows a much tougher and stiffer fin material and yet still allows the fin to twist and flex to assume a better shape. The strategy is to use a tough and stiff material for durability and gain flexibility with changes in geometry.

The current fin design and new fin of this invention are the same in that the fin is comprised of harder and stiffer under molded part with a softer and more flexible over molded part over that. The under molded part comprises the majority of the periphery of the fin which is the vulnerable part. There are two areas of the new fin invention where the geometry is changed to reduce bending stiffness and torsional stiffness:

1) In the head of the fin the under molding is much thinner about 0.06" and the bending stiffness of the fin is reduced in this area.
2) In the current design a hole is molded in the under molded part in the leading edge which receives the mast. This creates a tube which is very stiff in torsion. In the present invention the under molded part does not connect all the way around the mast which creates much less torsional stiffness.

The use of a stiffer under molded material provides two benefits:

1) Higher efficiency because of positive camber which is a better cross sectional shape. The more flexible material of the current fin design does not support the trailing edge sufficiently and under higher power situation the camber of the fin becomes negative which is not ideal for efficiency. FIG. 14 illustrates a foil section with positive camber and one with negative camber.
2) Positive camber provides more effective adjustability. It is desirable to be able to adjust the angle of attack of the fins which is analogous to changing the pitch of a propeller or changing the gear of a bike. This will change the resistance the user feels on the pedal. The current fin design attempts to control the angle of attack of the fin by limiting the twist of the fin by changing the tension in the trailing edge of the fin. This is analogous to sheeting in the sail of a sailboat. However, if the camber of the fin goes negative, the center of effort of the fin moves forward to the point where there is no torque available to twist the fin and there is no tension in the leach of the fin. The adjustment method is defeated. If the camber of the fin is positive the center of effort of the fin moves back and there is a large torque available to twist the fin. Changes in tension in the trailing edge of the fin will be effective at changing the twist of the fin.

The harder under molded material allows a new method of changing the tension in the clew. A set screw is threaded in the head of the fin and creates an adjustable stopper for the mast. The softer material of the previous design would not allow a set screw to work. This will adjust the tension in the trailing edge of the fin.

This invention comprises a second method of adjusting the angle of attack of the fin. The clew of the fin will be free to slide from side to side on the pin that provides the pivot for the mast link. The choice will be to select a shim or spacer that will limit the travel of the clew of the fin. If the clew is allowed to move that would correspond to a lower pitch propeller or lower gear and there will be less resistance on the pedal.

Roller Bearings

The invention also comprises the use of novel bushings on rotating components, the bushings comprising plastic roller bearings having felt seals.

The existing technology is simple, robust, reliable, and relatively efficient; however, about 8% of the energy input is wasted in friction. There are five components that have relatively high loads and rotate on plastic bushings; the right and left drums, the front and rear sprockets and the idler pulley. Ordinary steel ball bearings or roller bearing require ten seals to keep water out of the bearings. Plastic roller bearings work well with water as lubricant but will not tolerate dirt or sand. According to this invention felt seals are used which let water through, but filter dirt and sand out.

THE DRAWINGS

Turning to the drawings.

FIG. 8 is cross section view of the sprocket assembly.

DESCRIPTION OF THE PREFERRED EMBODIMENTS

Figure 1:
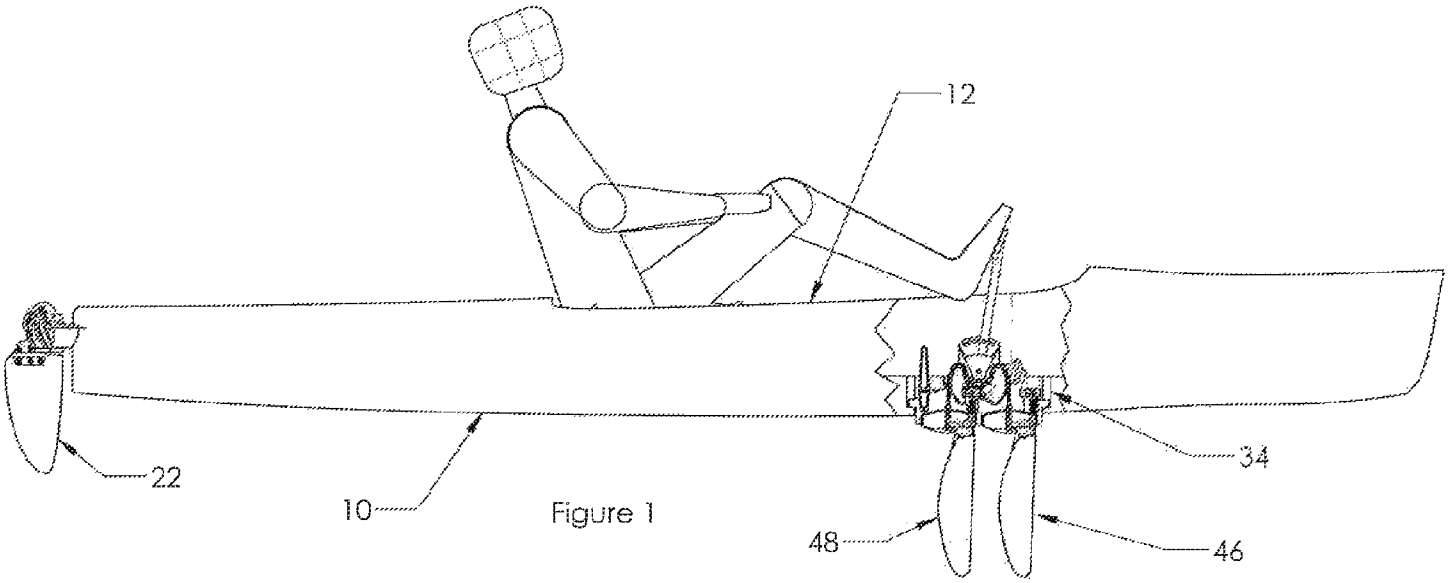
FIG. 1 is a side view of a kayak with a cut away of the hull to show the present invention.
Figure 2:
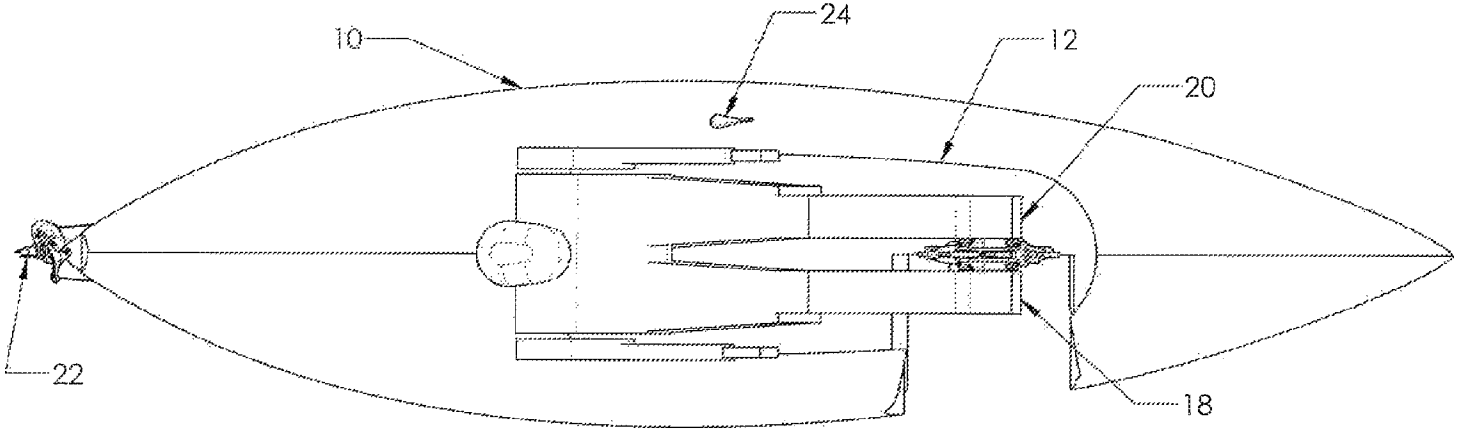
FIG. 2 is a top view of a kayak with the present invention
Figure 4:
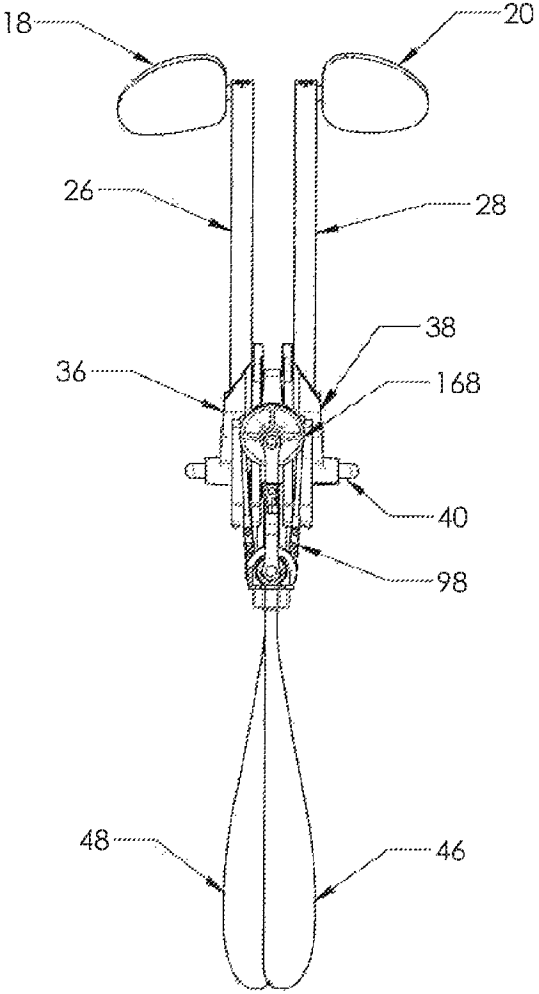
FIG. 4 is a front view of the invention.
Figure 3:
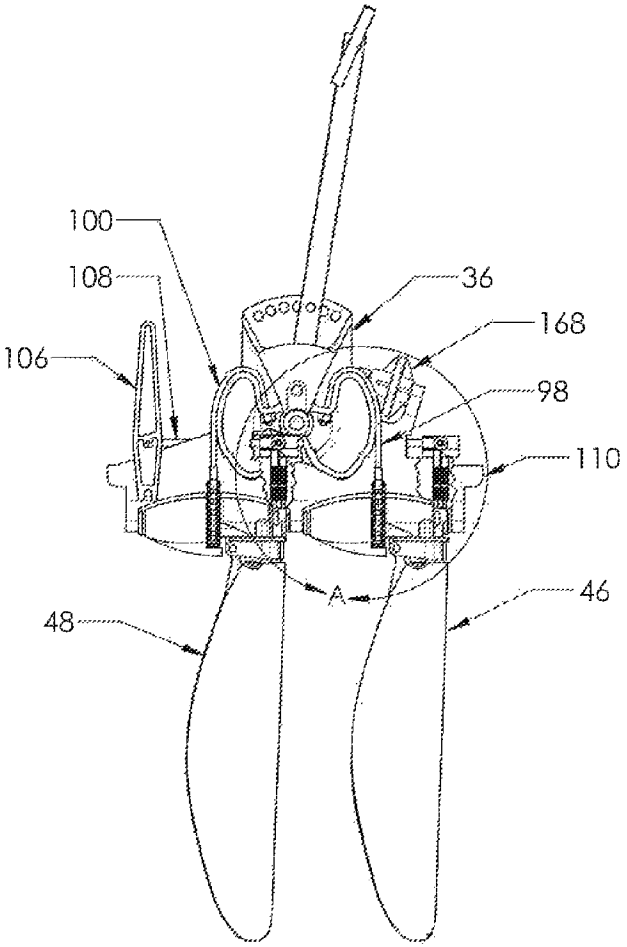
FIG. 3 is a side view of the invention.
Figure 5:
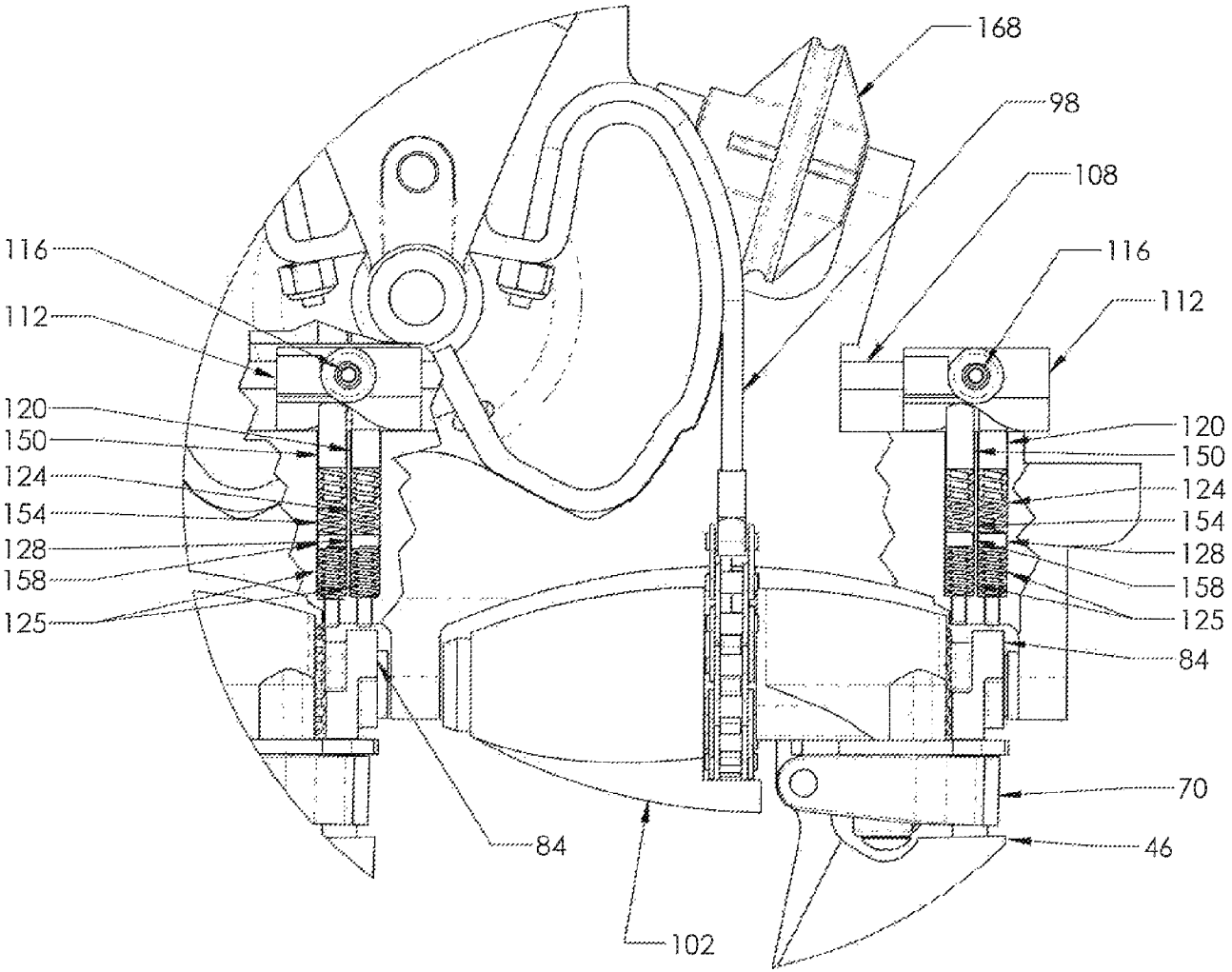
FIG. 5 is a detail view of FIG. 4.
Figure 6:
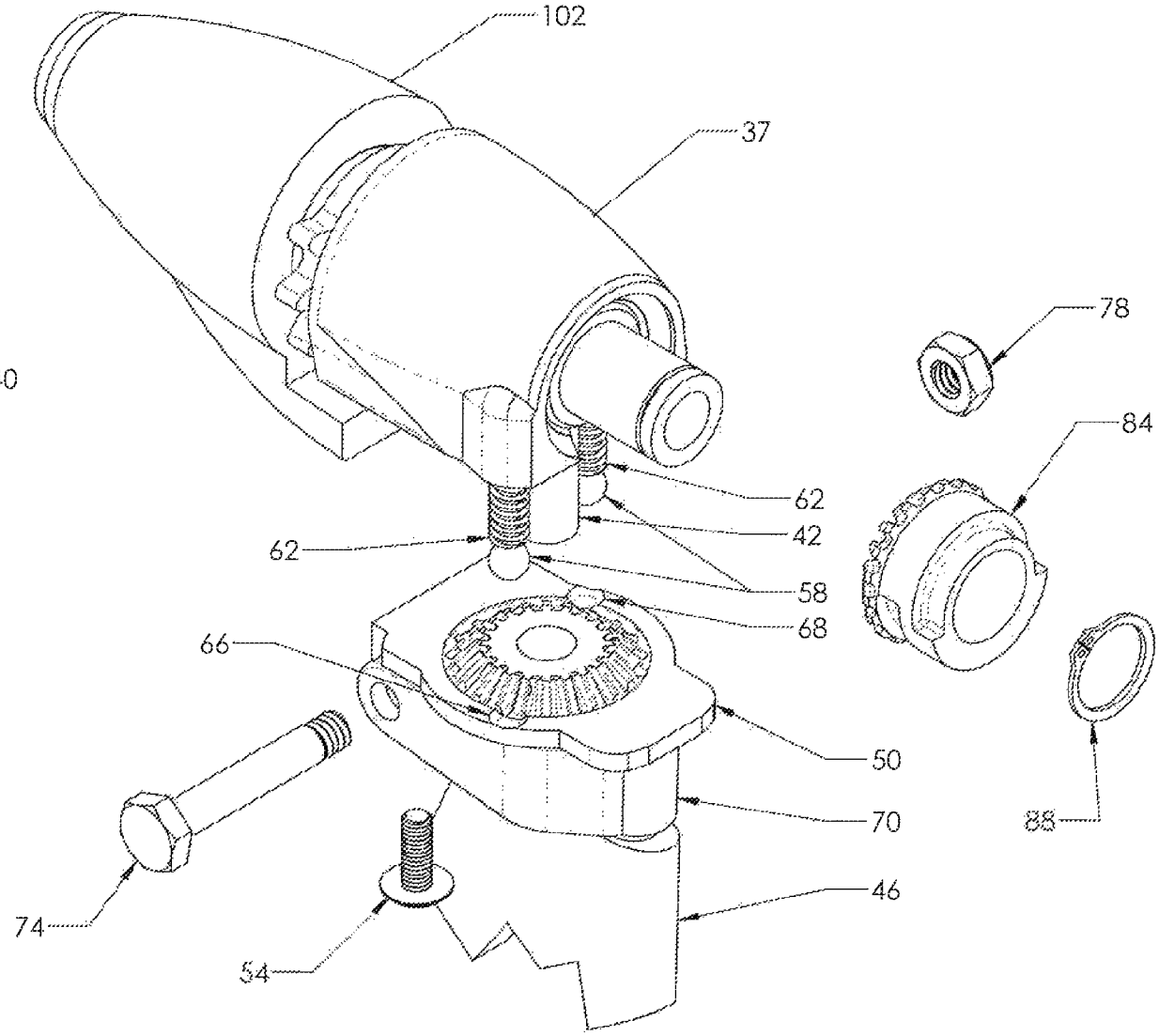
FIG. 6 is a perspective view of an exploded view of the sprocket assembly.
Figure 7:
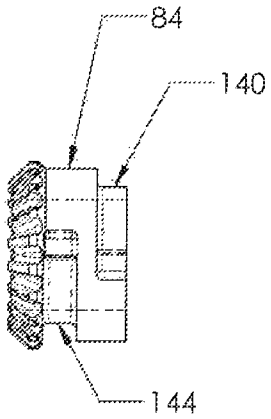
FIG. 7 is a side view of the sprocket gear.
Figure 9:
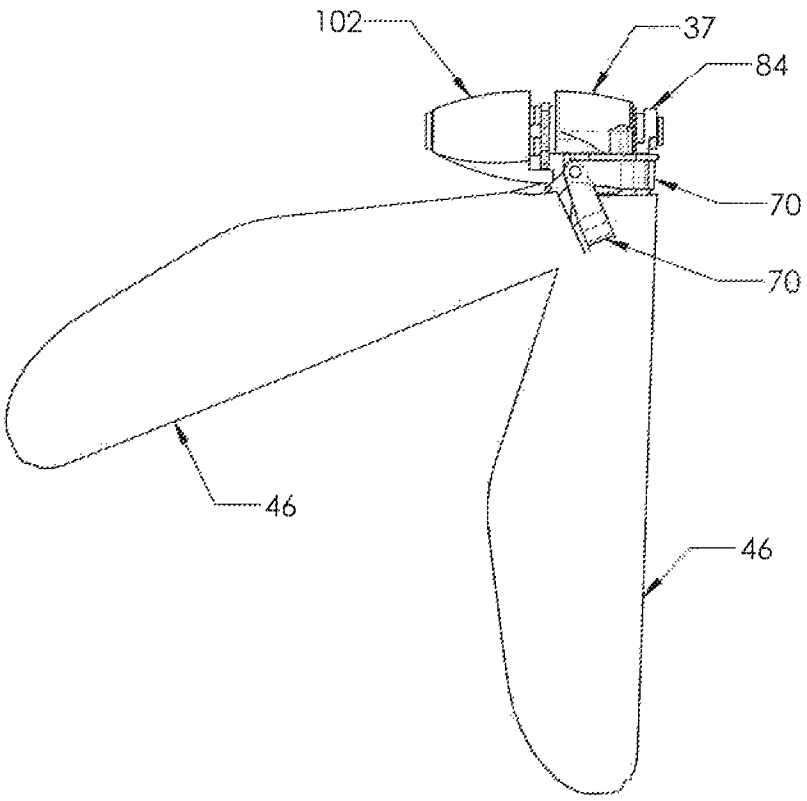
FIG. 9 is a side view of the sprocket assembly.
Figure 14:
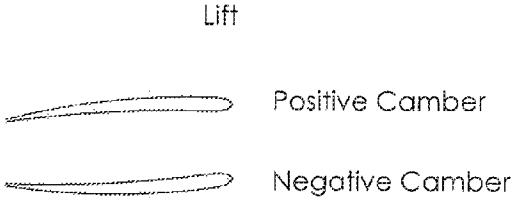
FIG. 14 shows a comparison of positive camber and negative camber.
Figure 15:
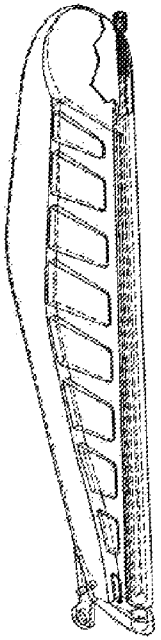
FIG. 15 shows a perspective view of the under molding of the fin.
Figure 11:
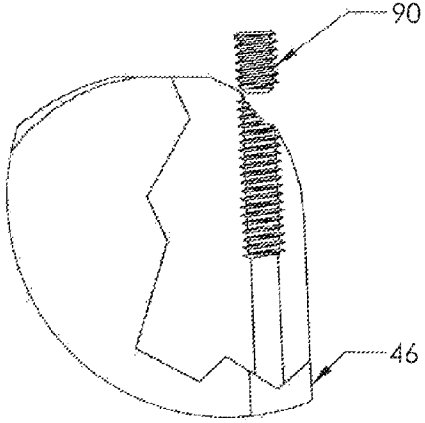
FIG. 11 is detail view of the top of the fin.

One preferred embodiment is a pedaled kayak propelled by the "penguin" like action of two transversely oscillating fins. As the force on the pedals is increased, the less restrained end of the fin will twist to assume a propeller like shape. As the fins oscillate, they change pitch or shape upon reaching the end of their arcuate movement, viz, when they simultaneously reverse direction of movement at the opposite ends of their arcuate pathway. This sail action is somewhat similar to what happens when tacking in a sailboat in that the sails exert, in both of their directions of movement, a forward thrust component.

Turning to the drawings in more detail, the drawings illustrate an embodiment of the invention in the form of a kayak having a generally elongated hull 10 made, for example, by rotomolding from a plastic such as polyethylene. The cockpit 12 also contains a set of pedals 18 and 20 adapted to be pushed, first one and then the other, by the user's feet. The hull 10 is also provided with a rudder 22 and tiller 24.

The pedals 18 and 20 are operatively connected by pedal shafts 26 and 28, respectively, to the propulsion means which extends downwardly through hole 34 of hull 10.

The drums 36 and 38 are rotatable about the fixed longitudinal steel shaft 40 which is connected to spine 110 and hull 10.

The rotatable sprockets 37 and 39 carry radially extending rigid shafts 42. The mast gear 50 rotates on shafts 42 and is secured by 10-32×0.5" truss head screws 54. Delrin balls 58 and springs 62 are installed in holes in the sprockets 37 and 39. The balls 58 are pressed against the mast gear 50 and fall into the detents 66 and 68 when the fins are in the forward thrust position or the reverse thrust position. The ¼-20×1.5" hex head bolt 74 with lock nuts 78 secure mast link 70 to the mast gears 50.

The fin 46 is secured to the mast link 70 with bolts 74. The reverse gear 84 is secured to the sprocket 37 with retaining ring 88. The teeth of reverse gear 84 meshes with the teeth of the mast gear 50 at a 1:1 ratio. The fairings 102 reduce the hydrodynamic drag.

The masts project in a generally downwardly direction so that they always remain in the water. The masts support the fins 46 and 48, respectively, at their leading edges. Each of the fins is rotatable about its mast, so that the edge of the fins opposite the leading edge can move from one side to the other with respect to the longitudinal center line of sprockets 37 and 39. This action results in both fins exerting of forward force or push on the watercraft in both directions of transverse movement of the fins, providing superior efficiency and speed. The extent of travel or movement of the trailing edges is limited in two ways: a) the tension in the trailing edge is adjusted with a set screw 90 and b) the travel of the clew of the fin is limited by the shim 94.

The sprockets 37 and 39 are connected to the drums 36 and 38 through the chain assemblies 98 and 100. The drums rotate relative to the sprockets in 1:4 ratio.

Lever 106 is pivotally attached to shaft 108 and causes shaft 108 to slide through a hole 109 in spine 110. Cams 112 are secured to shaft 108 with a set screw 116. When the lever 106 is moved forward the cams move forward and press down on the forward cam lifters 120 which press down on springs 124 which press down on pins 128. The pins press down onto sprocket gears 84. The tips of the pins slide on sprocket gears until the either pedal 18 or 20 is pressed all the way forward and the sprockets reach the end of their stroke. At that point the pins drop into the front groove 140 on the sprocket gear. The pins prevent the sprocket gear from turning with the sprocket. When a next stroke begins the sprocket gear will force the mast gear to rotate. As the sprocket rotates through a full cycle of 180 degrees the mast gear rotates 180 degrees from the reverse thrust position to the forward thrust position. If the lever is left in the forward position and the pin is left down, the sprocket gear will rotate freely with the pin moving in the forward groove.

When the lever 106 is pulled aft cams 112 press down on the reverse cam lifters 150 which press down on springs 154 which press down on pins 158. The pins press down onto sprocket gears and the tips of the pins slide on sprocket gears as the sprocket gears rotate. When either pedal 18 or 20 is pressed all the way forward and the sprockets reach the end of their stroke the pins drop into the rear groove 144. The rear groove is 180 degrees opposed to the front groove and so when the pin drops in the rear groove the fin assembly will rotate into the reverse thrust position. The four springs 125 lift up on the pins to return them to the neutral position.

If the fin 46 contacts a submerged object the mast link 70 will pivot aft about bolt 74. When the fin produces thrust again, the fin and mast link will pivot forward. When the mast link rotates forward the metal rod 160 depresses the plastic clip 164 and snaps into the forward position. This action holds the mast and fin in the forward position.

The fin is produced from two separate molds—the under molding and the over molding. The under molding 200 comprises the majority of the periphery of the fin, the leading edge, the trailing edge and the tip. The over molding comprises the core of the fin. The periphery of the fin is vulnerable to damage and so it is desirable to make the under molding from material which is as hard and tough as possible. Hard and tough materials are typically stiffer and do not allow the fin to twist sufficiently.

Figure 12:
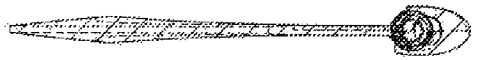
FIG. 12 is a section view of the fin.
Figure 13:
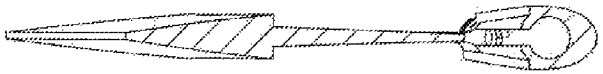
FIG. 13 is a section view of the fin.
Figure 10:
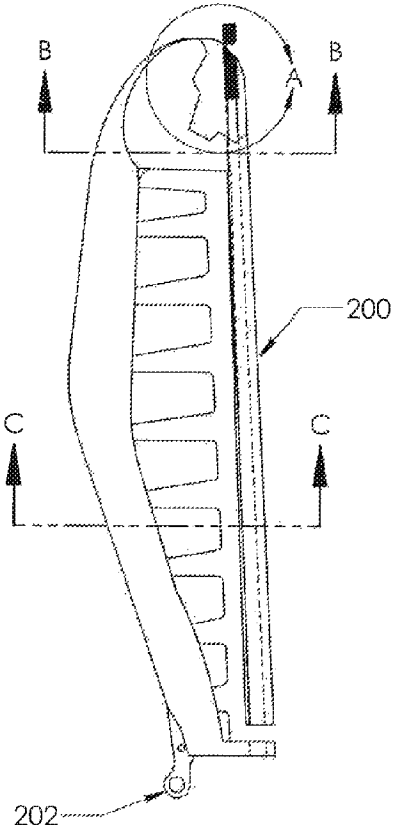
FIG. 10 is a side view of the under molding of the fin.
Figure 17:
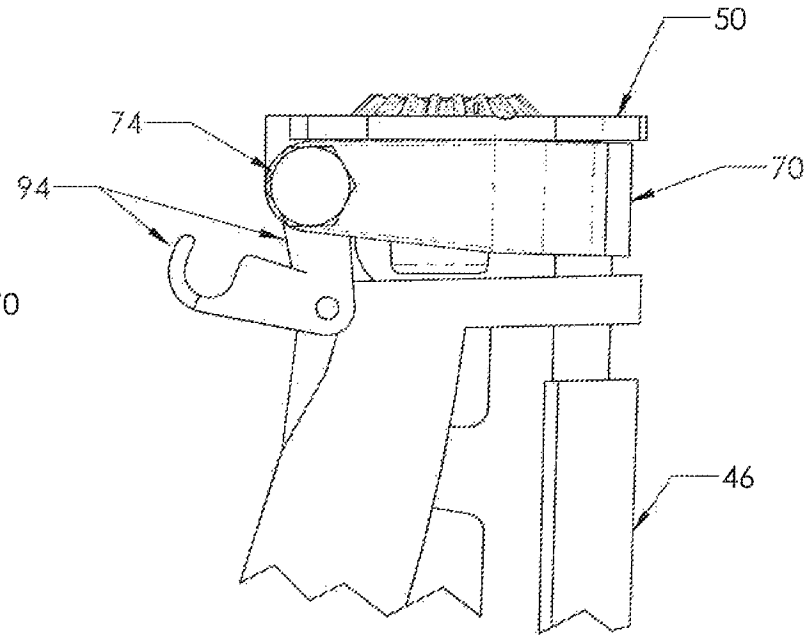
FIG. 17 shows a side view of the fin assembly.
Figure 16:
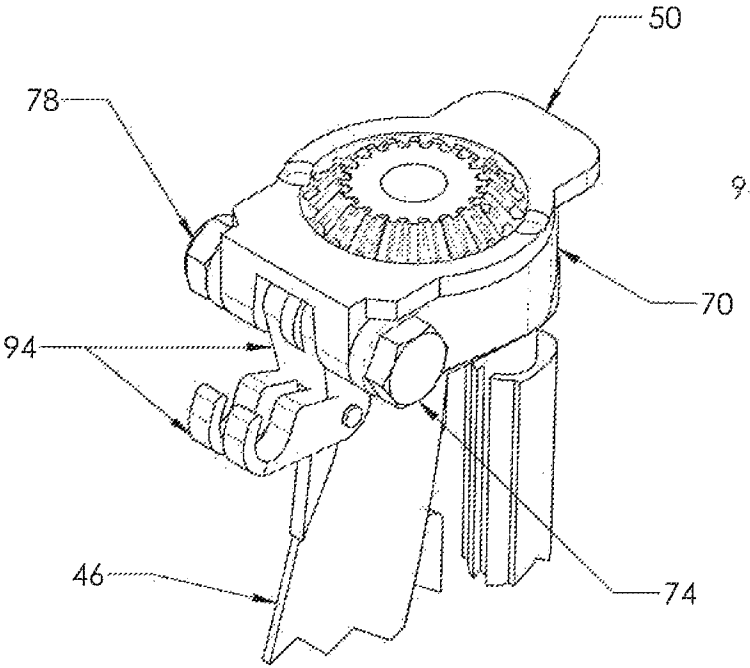
FIG. 16 shows a perspective view of the fin assembly.
Figure 18:
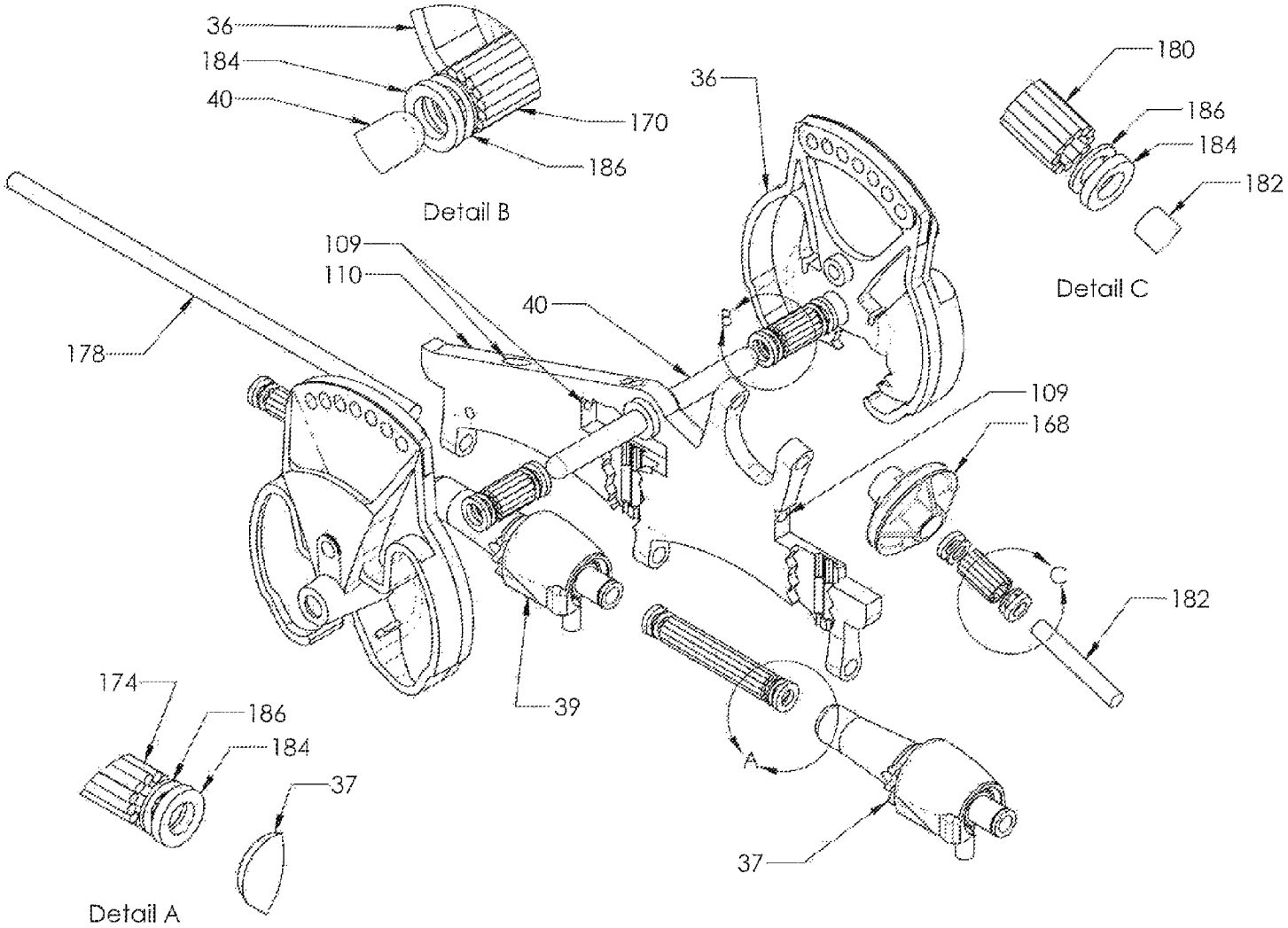
FIG. 18 shows an exploded view showing the bearings.

FIG. 13 shows a cross section of the under molding and shows that the leading edge is not a complete tube which is flexible in torsion. FIG. 12 shows how thin the under molding is in the tip of the fin which is flexible in bending. This invention will allow the under molding to be as hard as 80 D. The over molding is not as vulnerable and it should have a hardness of about 40 A.

The tip of the mast link 70 bears on the set screw 90 in the tip of the fin 46. By changing the location of the set screw the tension in the leach can be changed which changes the torsional stiffness of the fin.

The clew 202 of the fin 46 is free to slide on bolt 74 in the gap 204 of the mast gear 50. This motion will allow the base of the fin to rotate about +/−7 degrees. If the shim 94 is rotated into position the fin will be restricted to stay on center line which corresponds to a higher angle of attack, a higher pitch propeller, or a higher gear.

There are five rotating parts with significant loads on them that can produce significant friction; two drums 36 and 38, two sprockets 37 and 39, and the idler pulley 168. The roller bearings 170 go into the drum 36 and 38 and then they slide onto the shaft 40 which is mounted to the spine 110. These roller bearings will roll between the plastic drum and the stainless steel shaft. The roller bearings 174 go into the sprockets 37 and 39 and then the sprocket shaft 178 mounts the sprockets to the spine 110. The idler pulley 168 rolls on roller bearings 180 on the shaft 182.

These rollers are made from ⅛" diameter Delrin rod. There are fifteen bearings in each of the drums and twelve bearings in each of the sprockets and idler pulley. The bearings are about 1.5" long in the drums, 3.5" long in the sprockets, and about 1.2" long in the idler pulley. These bearings would not tolerate debris. There are ten felt washers 184 one each end of each set of rollers which allow water in, but filter dirt out. The ten plastic washer 186 protects the felt washer from the roller bearings.

The invention claimed is:

1. A novel watercraft having propulsion means extending below the water line comprising a pair of flexible fins each rotatable on a substantially horizontal axis and each being adapted to oscillate through an arcuate path in a generally transverse direction with respect to the central longitudinal dimension of said watercraft, input means operatively associated with said pair of flexible fins for applying input force to oscillate said pair of flexible fins, and means for positioning said pair of flexible fins to propel said watercraft forward and to simultaneously rotate each of said pair of flexible fins 180° about separate axes which are each disposed at a substantially right angle to said horizontal axis to propel said watercraft aft, whereby as input force is applied, said flexible fins can twist to form an angle of attack for providing forward or aft thrust with respect to the longitudinal dimension of the watercraft while moving said flexible fins in both directions along said arcuate path.

2. The novel watercraft of claim 1 wherein means operatively associated with said propulsion means for applying input force comprises a pair of foot pedals and said means for positioning is rotatable 180° with respect to said foot pedals.

3. The watercraft of claim 1 wherein the watercraft is a kayak having a hull, keel and a cockpit.

4. A novel device adapted to be placed in a watercraft, said device comprising propulsion means adapted to extend below the water line comprising a pair of flexible fins each rotatable on a substantially horizontal axis and each being adapted to oscillate through an arcuate path in a generally transverse direction with respect to the central longitudinal dimension of said watercraft, input means operatively associated with said pair of flexible fins for applying input force to oscillate said pair of flexible fins, and means for positioning said pair of flexible fins to propel said watercraft forward and to simultaneously rotate each of said pair of flexible fins 180° about separate axes which are each disposed at a substantially right angle to said horizontal axis to propel said watercraft aft, whereby as input force is applied, said flexible fins can twist to form an angle of attack for providing forward or aft thrust with respect to the longitudinal dimension of the watercraft while moving said flexible fins in both directions along said arcuate path.

* * * * *